US007043948B1

(12) United States Patent
Wang

(10) Patent No.: US 7,043,948 B1
(45) Date of Patent: May 16, 2006

(54) RESETTABLE COMBINATION LOCK

(75) Inventor: Song-Ming Wang, No. 24, Lane 49, Fu Hua 8th Street, Yung Kang City, Tainan Hsien (TW)

(73) Assignees: Song-Ming Wang, Tainan Hsien (TW); Mei-Li Wang, Tainan (TW)

( * ) Notice: Subject to any disclaimer, the term of this patent is extended or adjusted under 35 U.S.C. 154(b) by 11 days.

(21) Appl. No.: 10/994,398

(22) Filed: Nov. 23, 2004

(51) Int. Cl.
*E05B 13/00* (2006.01)

(52) U.S. Cl. ..... 70/214; 70/298; 70/299; 70/327

(58) Field of Classification Search ..... 70/213, 70/214, 286–290, 297–300, 327, 446, DIG. 44
See application file for complete search history.

(56) References Cited

U.S. PATENT DOCUMENTS

| | | | | | |
|---|---|---|---|---|---|
| 2,109,264 | A * | 2/1938 | Elbaum | 70/298 |
| 3,937,046 | A * | 2/1976 | Wang | 70/81 |
| 4,748,833 | A * | 6/1988 | Nagasawa | 70/214 |
| 4,838,057 | A * | 6/1989 | Schwend | 70/214 |
| 4,936,894 | A * | 6/1990 | Larson et al. | 70/298 |
| 5,186,032 | A * | 2/1993 | Chia | 70/315 |
| 6,298,698 | B1 * | 10/2001 | Nakajima et al. | 70/214 |
| 6,334,346 | B1 * | 1/2002 | Wang | 70/214 |
| 2003/0131639 | A1 * | 7/2003 | Segawa | 70/92 |
| 2004/0261477 | A1 * | 12/2004 | Wang | 70/214 |

* cited by examiner

*Primary Examiner*—Lloyd A. Gall
(74) *Attorney, Agent, or Firm*—Rosenberg, Klein & Lee

(57) ABSTRACT

A resettable combination lock includes two rows of main buttons, and rotary resetting buttons in a rear indoor portion, which are respectively connected to the main buttons for causing angular displacement of the main buttons with; each main button includes a stick formed with first and second trenches, which face opposite directions, and are different distances from a rear end of the stick; the sticks pass through two slots of a plate such that linear displacement of the plate will be prevented when the main buttons are not depressed exactly according to the combination; the lock can be reset in respect of the combination by turning the rotary resetting buttons one hundred and eighty degrees to change the orientation of the trenches of the sticks; the lock is equipped with several telescopic connecting elements therein so as to be adaptable to doors of different thicknesses.

16 Claims, 17 Drawing Sheets

RESETTABLE COMBINATION LOCK

BACKGROUND OF THE INVENTION

1. Field of the Invention

The present invention relates to a resettable combination lock, more particularly one, which can be easily reset, and which can be easily adapted to suit doors of different thicknesses.

2. Brief Description of the Prior Art

Combination locks are convenient to use because they can be unlocked without use of a key, and there won't be risk of losing the key.

Referring to FIGS. 14 to 17, a conventional resettable combination lock includes a lock member 10 secured on an outer side of a door 40, a back cover 20 securely connected to an inner side of the door 40 and the lock member 10, and a knob 30.

The lock member 10 includes:

a housing 101 formed with two rows of spaced holes 102 thereon, which are given respective numbers or symbols;

several buttons 103 held in respective ones of the holes 102 of the housing 101, which includes a restoring button, which can be pressed for making the other buttons released from the pressed position; each button 103 has a spring 160 held therein;

a main body 104 securely held in the housing 101; the main body 104 is formed with two rows of spaced holding holes 105 thereon, which face respective ones of the holes 102 of the housing 101;

several locking plates 50 passed through respective ones of the holes 105 of the main body 104, touching the corresponding springs 106 at upper ends (according to FIG. 16); there are first and second types of locking plates 50; each of all the locking plates 50 has both a small gap 502 and an engaging protrusion 503 on an inwards-facing edge, and has a big gap 501 on an outwards-facing edge; the first type have their big gaps 501 near to upper ends thereof while the second type have their big gaps 501 near to lower ends thereof; each engaging protrusion 503 has a sloping side;

a rear cover 108 securely connected to a rear end of the housing 101;

several springs 107 touching the rear cover 108 at first ends and touching respective ones of the locking plates 50 at second ends for biasing the locking plates 50 upwards (according to FIG. 16);

an engaging plate member 70 having a lengthways extending big slot 701 thereon, and several small gaps 702 spaced along two long sides of the inner edge, communicating with the slot 701; the engaging plate member 70 is positioned next to the main body 104, around the locking plates 50 and linearly displaceable relative to the main body 104 in the direction of the long sides thereof; and an elongate detaining member 60 up and down movably arranged between the two rows of locking plates 50; the detaining member 60 has hooked elastic engaging portions 601, which are spaced apart along two long sides thereof, and which face respective ones of the locking plates 50 for releaseably detaining the locking plates 50; the detaining member 60 is connected to the restoring button such that it will move to a lower position (according to FIG. 16) and disengage the locking plates 50 as soon as the restoring button is pressed.

The knob 30 and a dead bolt 301 are connected to the housing 101 in such a way that the dead bolt 301 will retreat into and project out from the housing 101 as soon as the knob 30 is turned. And, the knob 30 is connected to the engaging plate member 70 in such a way that it can be turned only when the engaging plate member 70 is free to move without being stopped by the locking plates 50.

When the numbered buttons are pressed, the locking plates 50 will move towards the rear cover 108, with the sloping sides of the engaging protrusions 503 sliding on the hooked elastic engaging portions 601 of the detaining member 60. Consequently, the engaging portions 601 of the detaining member 60 will engage the locking plates 50 to detain the same in the pressed position.

The locking plates 50 will project into the small gaps 702 of the engaging plate member 70 to prevent the plate member 70 from moving when the combination lock locks. And, when the numbered buttons are pressed according to the unlocking combination, i.e. all of the locking plates 50 of the first type are in the pressed position, and also none of the locking plates of the second type are in the pressed position, all of the big gaps 501 will face the engaging plate member 70. Consequently, the engaging plate member 70 will be free to move without being stopped by the locking plates 50, and in turns the knob 30 can be turned so as to retreat the dead bolt 301 into the lock member 10.

Because the buttons will be polished after they have been pressed many times, the user should reset the combination lock occasionally in order to prevent thieves from telling the frequently pressed buttons from the rarely pressed ones of the lock from the appearance, thus finding out the unlocking combination. To reset the combination lock, one has to carry out the following steps:

(1) removing the lock member 10 from the door, and separating the rear cover 108 from the housing 101;

(2) removing the springs 107;

(3) removing the locking plates 50 by means of pliers while making the restoring button stay in the pressed position such that the locking plates 50 are free to move without being stopped by the detaining member 60;

(4) relocating locking plates 50 of the first and the second types in the holes 105 of the main body 104 according to the new unlocking combination; and (5) fitting the springs 107 and the rear cover 108 back to the housing 101, and securing the whole lock member 10 to the door.

From the above description, it can be understood that the above conventional lock has the following disadvantages:

1. Because locking plates 50 of the first type are different from the second type in respect of position of the big gaps 501, the user has to relocate the locking plates in the holding holes 105 of the main body 104 with the help of tools in order to change the combination. Therefore, it takes much time and labor to reset the lock.

2. It is relative difficult to remove the locking plates from the holding holes 105, even with pliers, because the holes 105 are narrow. Consequently, the user will get some trouble with resetting the lock.

3. To reset the lock, the user has to first remove the lock member 10 from the door, and separate the rear cover 108 from the housing 101, and remove the springs 107 as well as relocating the locking plates, and finally he has to connect the rear cover back to the housing, and the lock member back to the door. Therefore, it takes a lot of time and labor to reset the lock. Furthermore, the springs are prone to get lost during the course of the above resetting action.

4. In removing the locking plates, the user has to keep the detaining member 60 in the pressed position by means of pressing the restoring button such that the locking plates 50 are free to move without being stopped by the detaining member 60. Consequently, the user has to press the restoring button with one hand, and hold pliers with the other.

5. There are two types of locking plates whose big gaps are formed in different positions. Therefore, the cost of manufacturing and material management will increase, and one can locate the two types of locking plates in wrong holding holes 105 while assembling the lock.

SUMMARY OF THE INVENTION

It is a main object of the present invention to provide an improvement on a resettable combination lock to overcome the above disadvantages.

The combination lock of the present invention includes two rows of main buttons projecting out from a front side of an outdoor member, and rotary resetting buttons in an indoor member thereof, which are respectively connected to the main buttons. Each of the main buttons includes an engaging stick formed with first and second trenches, which face opposite directions, and are different distances from a rear end of the stick. The engaging sticks of the buttons are passed through two juxtaposed slots of a plate such that linear displacement of the plate will be prevented when the main buttons are not depressed exactly according to the combination. The lock is to be reset in respect of the combination by means of turning the rotary resetting buttons one hundred and eighty degrees such that the first and the second trenches of the sticks of the main buttons change in orientation. Telescopic connecting elements are connected to a rear cover of the outdoor member and a seat part of the indoor member, through which the resetting buttons are passed, such that the present lock can be adapted to suit doors of different thicknesses.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
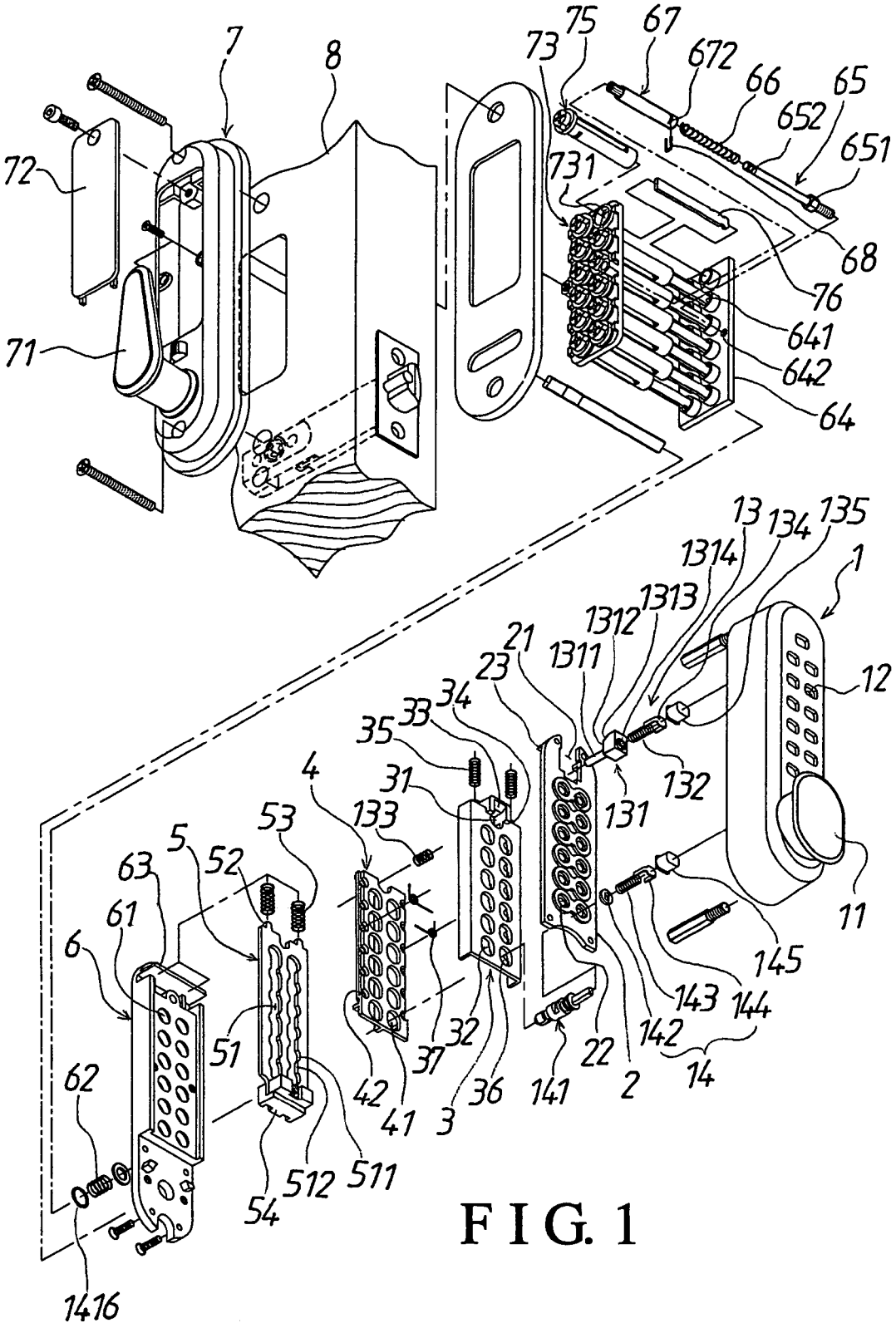
FIG. 1 is an exploded perspective view of the combination lock according to the present invention.
Figure 2:
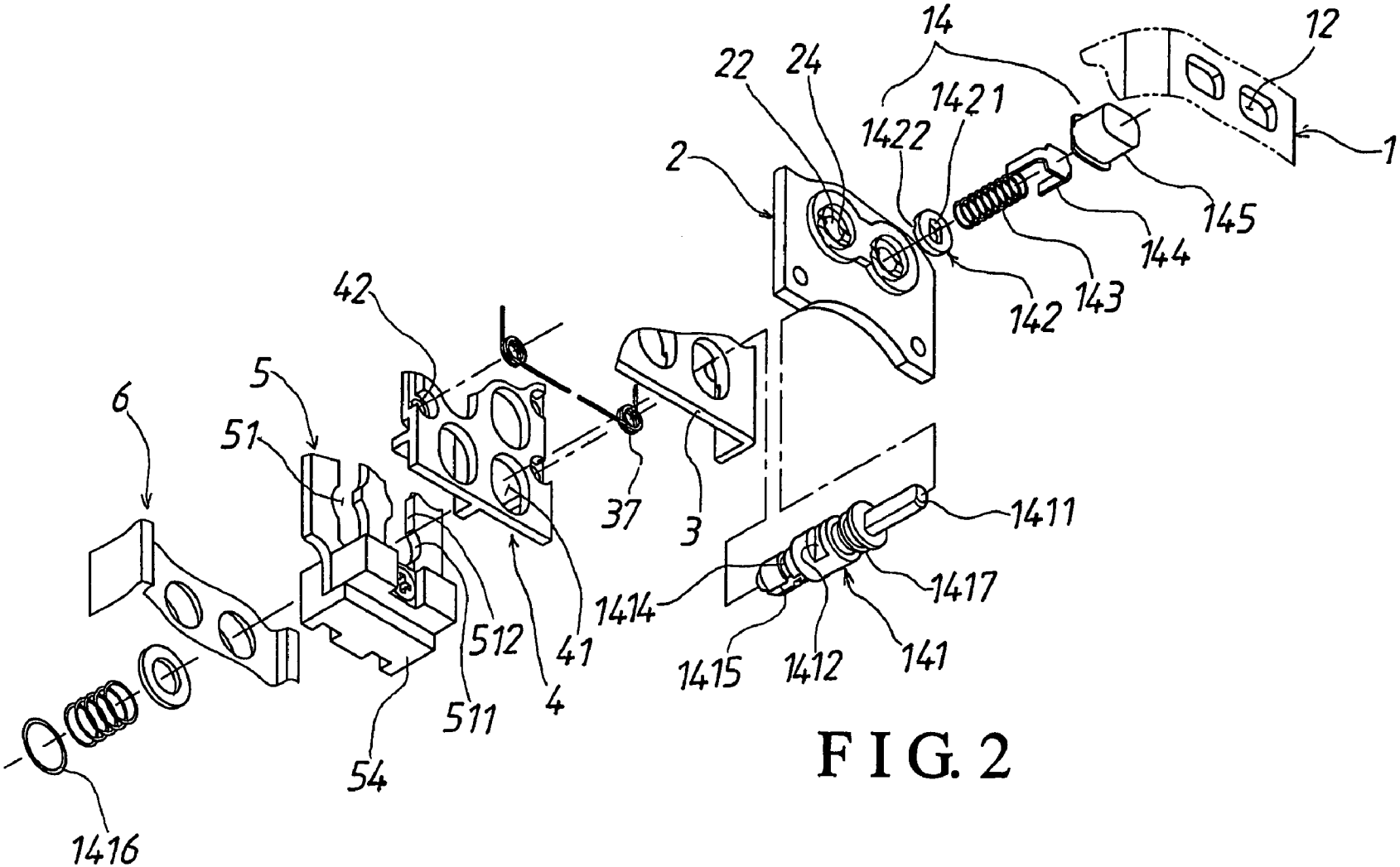
FIG. 2 is a partial exploded perspective view of the resettable combination lock according to the present invention (1)
Figure 3:
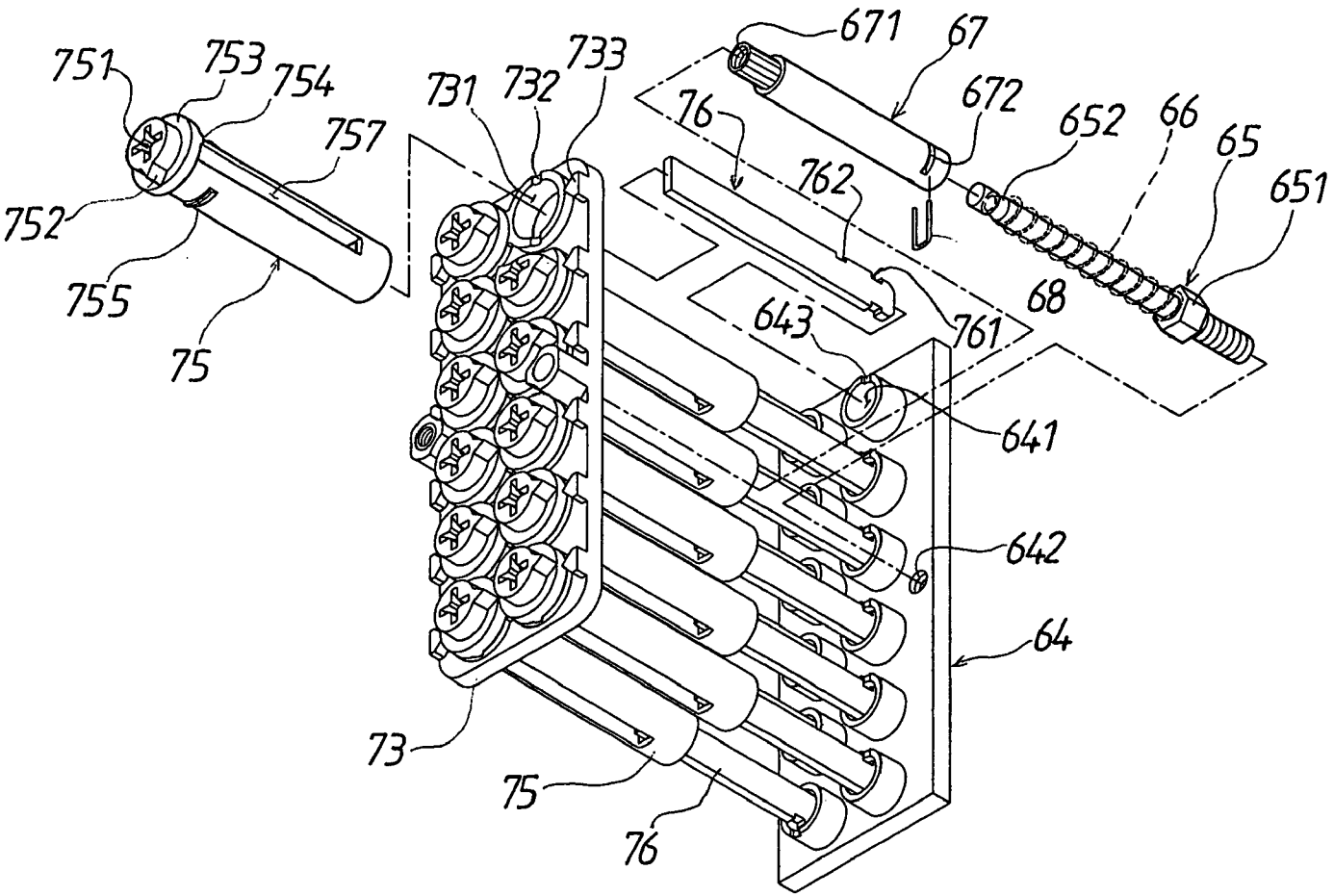
FIG. 3 is a partial exploded perspective view of the resettable combination lock according to the present invention (2)
Figure 4:
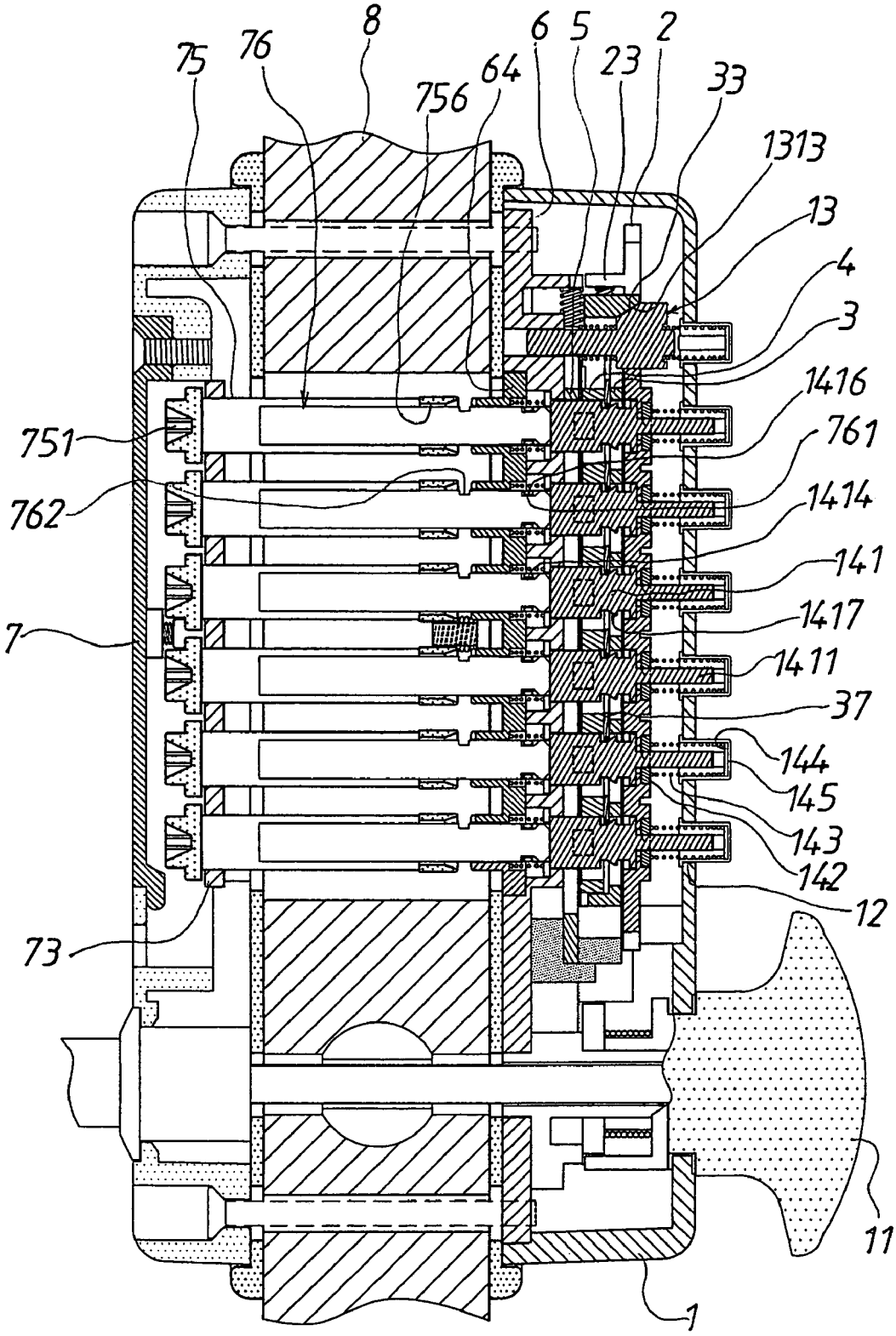
FIG. 4 is a sectional view of the present lock secured on a door.

Referring to FIGS. 1 to 3, a preferred embodiment of a resettable combination lock includes an outdoor member 1 secured on an outer side of a door 8, and an indoor member 7 on an inner side of the door 8.

Figure 5:
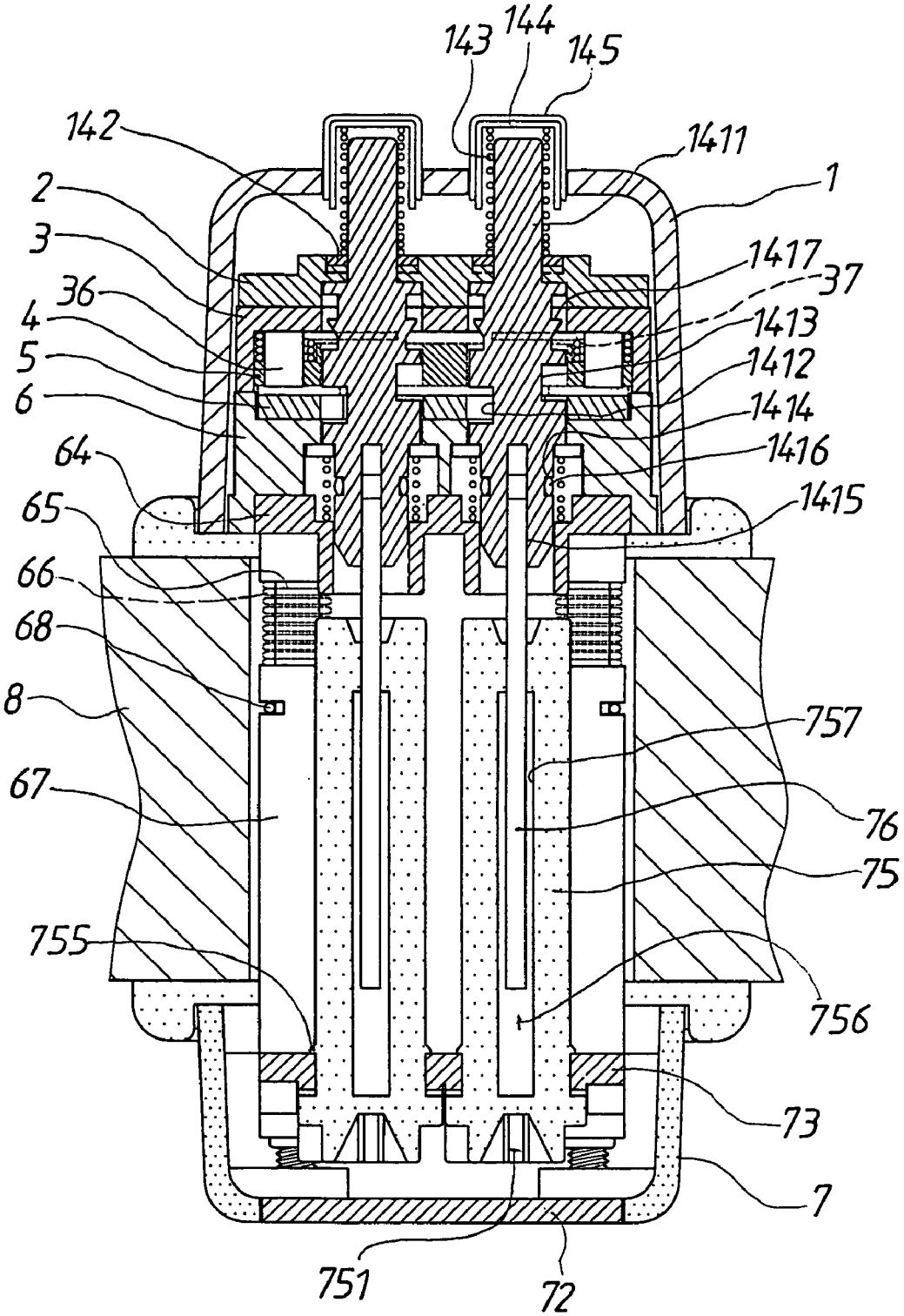
FIG. 5 is another sectional view of the present combination lock.
Figure 6:
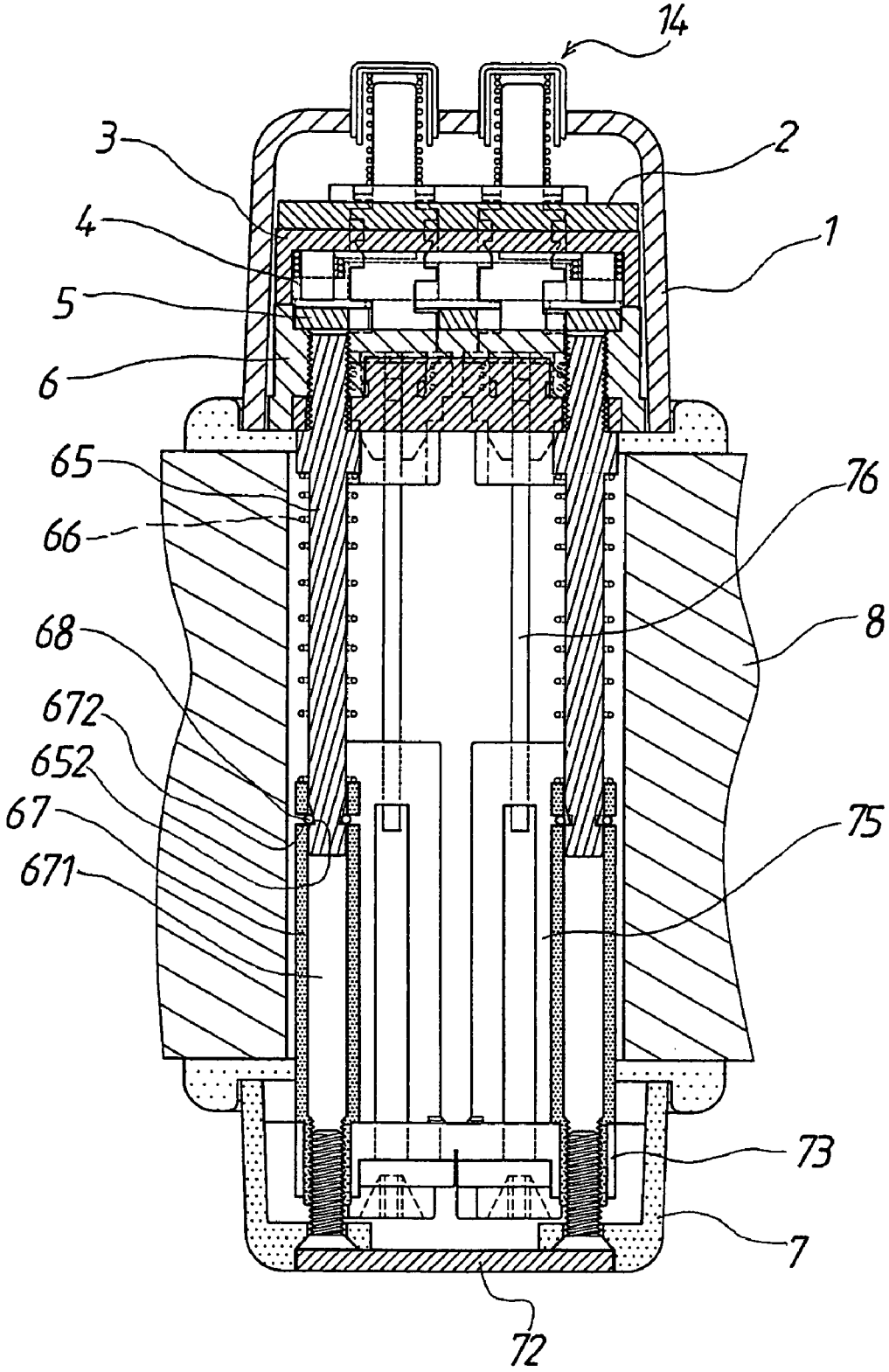
FIG. 6 is yet another section of the present combination lock.
Figure 7:
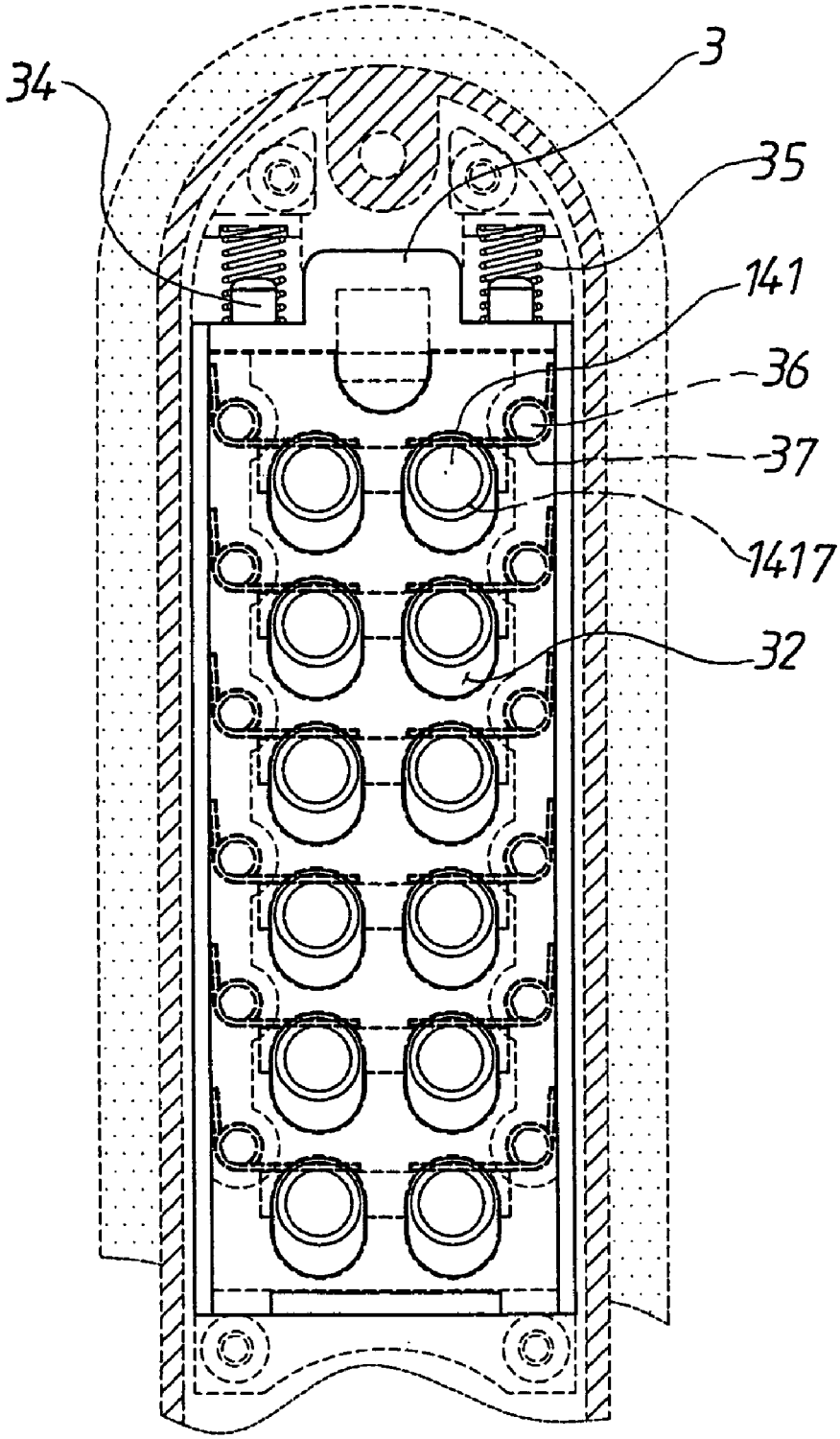
FIG. 7 is a view showing the structure of the present lock (1)
Figure 8:
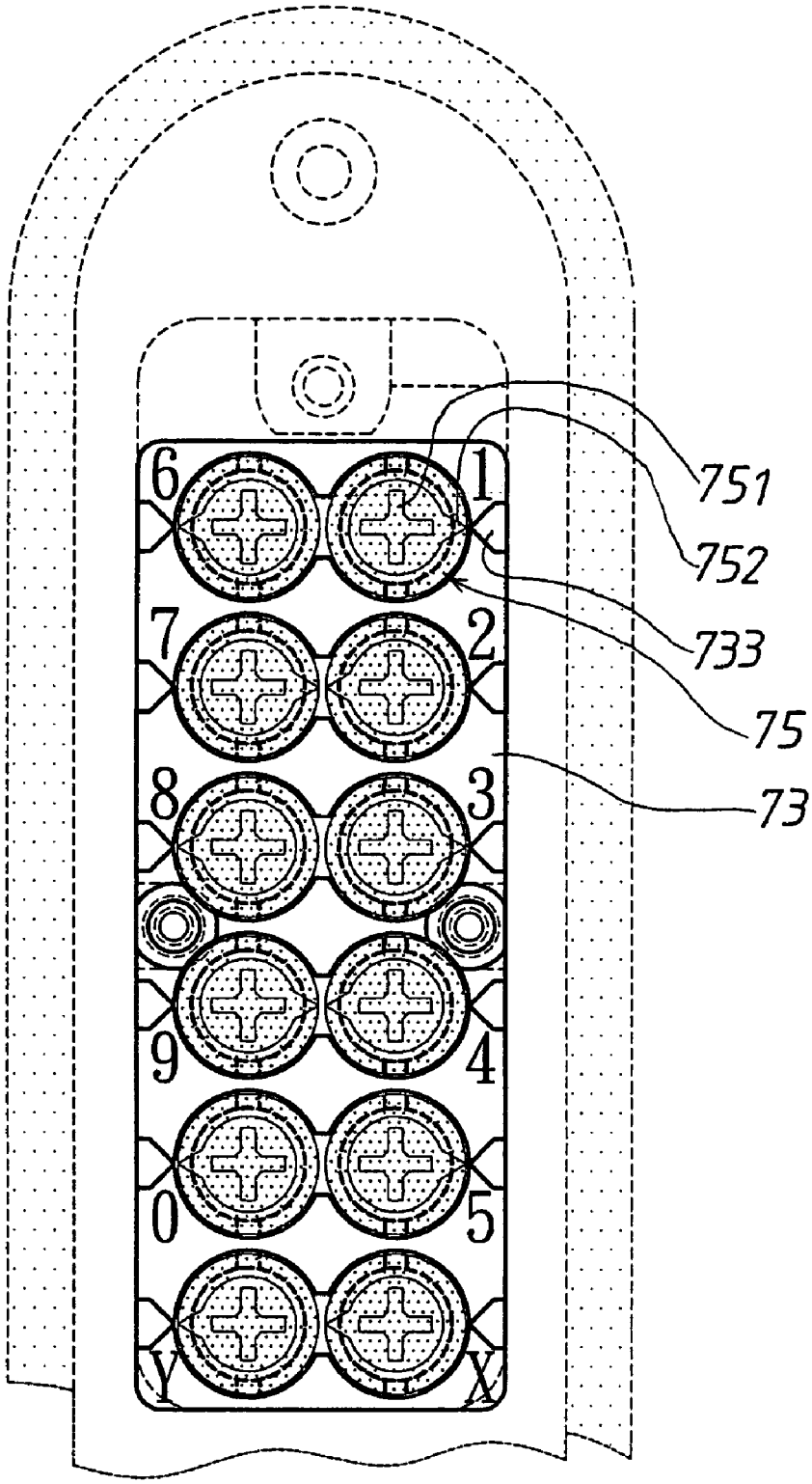
FIG. 8 is a view showing the structure of the present lock (2)
Figure 9:
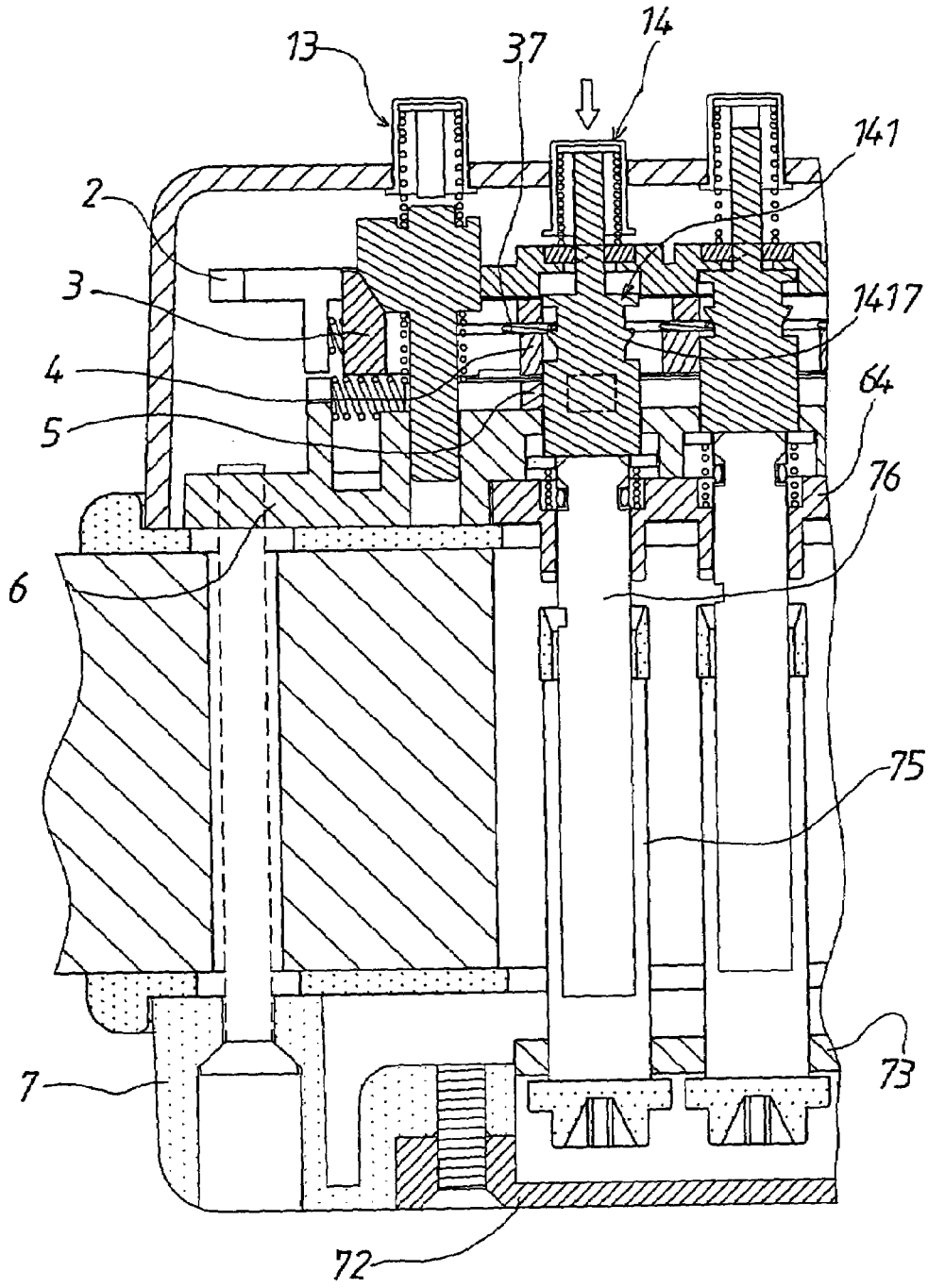
FIG. 9 is a partial sectional view of the present combination lock, with one of the buttons being pressed.
Figure 10:
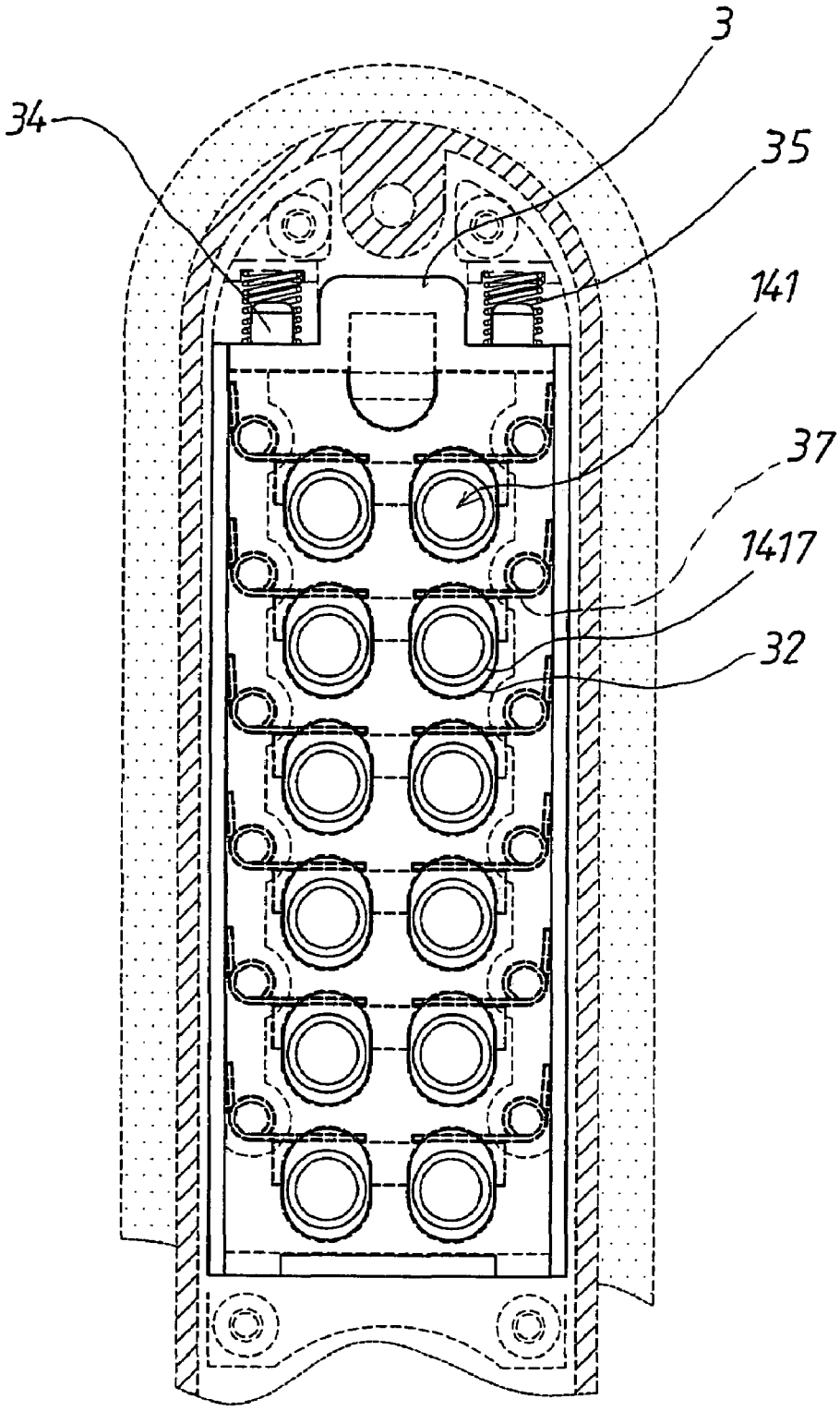
FIG. 10 is a view of the present lock, with the knob being turned.

The outdoor member 1 includes:

a housing having a knob 11 connected thereto, and several spaced holes 12 on a front side;

a restoring button 13 passed through one of the holes 12 of the housing; the restoring button 13 includes a rear pushing post 131, a front spring 132, a rear spring 133, an inner cap 134, and an outer cap 135; referring to FIG. 5 as well, the rear pushing post 131 has a rear post portion 1311, around which the rear spring 133 is passed; the post 131 further has a block portion 1312, which is formed with a slope 1313 on a rear side, and a front recess 1314 holding one end of the front spring 132; the inner cap 134 is fitted on the other end of the front spring 132 while the outer cap 135 is fitted over the inner cap 134, and passes through the corresponding hole 12;

several main buttons 14 passed through the other holes 12; referring to FIGS. 5 and 6 as well, each main button 14 includes an engaging stick 141, a ring 142, a spring 143, an inner cap 144, and an outer cap 145; each engaging stick 141 has a front post portion 1411 having a polygonal section, and a middle portion formed with both first and second trenches 1412 and 1413, which are different distances from the rear end of the engaging stick 141, as shown in FIG. 5; each engaging stick 141 further has an annular trench 1414 around a rear portion thereof, a gap 1415 extending along the whole length of the rear portion, and an annular protrusion 1417 between the front post portion 1411 and the middle portion, which annular protrusion 1417 has a sloping rear side; each ring 142 has a polygonal hole 1421, and a recess 1422 on a rear side, and it is closely positioned around the corresponding front post portion 1411; the springs 143 are positioned around respective ones of the front post portions 1411; the inner caps 144 are positioned around front ends of the corresponding front post portions 1411 while the outer caps 145 are positioned over the inner caps 144, and project out from the corresponding holes 12;

a fixed seat 2 positioned in the housing, and having a gap 21, through which the rear pushing post 131 of the restoring button 13 is passed; the fixed seat 2 has two rows of spaced through holes 22, through which the front post portions 1411 of the engaging sticks 141 of the buttons 14 are passed; the fixed seat 2 further has two stopping plate portions 23 on two sides of the gap 21, projecting rearwards; the fixed seat 2 has locating protrusions 24 next to the through holes on the front side, which are fitted onto respective ones of the recesses 1422 of the rings 142;

a first restoring seat 3 positioned next to the fixed seat 2 in the housing; the first restoring seat 3 has a first hole 31, and several second holes 32, through which first hole 31 the rear pushing post 131 of the restoring button 13 is passed, and through which second holes 32 the engaging sticks 141 of the buttons 14 are respectively passed; a front end of the first hole 31 is defined by a slope 33, which slope 33 is close to and faced with the slope 1313 of the rear pushing post 131; the first restoring seat 3 further has two locating posts 34 on two sides of the first hole 31 while springs 35 are passed around and located by the posts 34, and respectively pressed against the stopping plate portions 23 of the fixed seat 2; the first restoring seat 3 has several second locating posts 36 next to the second holes 32, and torsion springs 37 are fitted onto respective ones of the second posts 36, and pressed against lateral wall portions of the first restoring seat 3 and the corresponding engaging sticks 141 at two ends thereof;

a second restoring seat 4 positioned next to the first restoring seat 3 in the housing; the second restoring seat 4 has several through holes 41, which face the second holes 32 of the first restoring seat 3 respectively, and through which the engaging sticks 141 of the buttons 14 are passed; the second restoring seat 4 further has several holes 42, in which the second posts 36 of the first seat 3 are held such that one of the first and the second seats 3 and 4 can make the other move together with it;

a pushing plate 5 positioned next to the second restoring seat 4 in the housing; the pushing plate 5 has two slots 51 lengthways extending along it, which face respective ones of the two rows of holes 41 of the second restoring seat 4, and through which the engaging sticks 141 of the buttons 14 are passed; the edges of the slots 51 are formed with spaced apart concavities 511 and straight portions 512; the pushing plate 5 further has two locating posts 52, onto which posts 52 springs 53 are located, and a pushing protrusion 54, which is pressed against the first and the second restoring seats 3 and 4;

a rear seat 6 disposed next to the pushing plate 5; the rear seat 6 has holes 61, which face respective ones of the holes 41 of the second restoring seat 4; springs 62 are respectively held in the holes 61, and pressed against the engaging sticks 141 of the buttons 14 for biasing the sticks 141 forwards; the rear seat 6 further has a stopping protrusion 63, against which protrusion 63 the springs 53 of the pushing plate 5 are pressed at the other ends; the rear seat 6 has a cover part 64 on a rear side thereof, which has holes 641 facing respective ones of the holes 61, and which is formed with screw holes 642 thereon; telescopic connecting elements are connected to the cover part 64 of the rear seat 6, and a seat part 73 of the indoor member 7, each of which telescopic connecting elements includes a fixing stick 65, a spring 66, and a sleeve 67; the fixing sticks 65 are screwed into the screw holes 642 and the rear seat 6 at front threaded ends thereof to join the cover part 64 and the rear seat 6 together; a rear side of the cover part 64 further has symbols thereon, which consist of cavities 643, and which are next to the edges of the holes 641; each fixing stick 65 has a stopping protrusion 651 next to the front threaded ends, such that the stick 65 will be stopped in desired position while being screwed into the screw holes 642; each fixing stick 65 has a tapering neck portion 652, and it is passed through both a spring 66 and a sleeve 67, which has a holding room 671, from the rear portion thereof; the springs 66 are pressed against the front ends of the sleeves 67 such that they can bias the fixing sticks 65 forwards; each sleeve 67 has two opposing holes 672 communicating with the holding room 671 thereof, and U-shaped clipping elements 68 are fitted in the holes 672 and tightly pressed against the tapering neck portions 652 of the fixing sticks 65 such that the fixing sticks 65 and the sleeves 67 won't separate when the springs 66 are free to stretch without compressing force exerted thereon; the sleeves 67 are securely connected to the indoor member 7 at the rear ends thereof.

Besides the seat part 73, the indoor member 7 has a handle 71, and a detachable cover 72, and several rotary resetting buttons 75, which are substantially in the shape of a tube; the seat part 73 has several through holes 731 thereon, which face respective ones of the holes 61 of the rear seat 6, and it has gaps 732 formed on a rear side thereof, which are next to the through holes 731; the through holes 731 are given respective signs 733; the rotary resetting buttons 75 are passed through respective ones of the holes 731, and each has engaging cavities 751 on a rear end, and a sign 752 facing the same direction as the corresponding first trench 1412 of the fixing sticks 141; the signs 752 are provided for allowing the user to easily find out which buttons 14 the resetting buttons 75 are respectively associated with; each resetting button 75 further has an annular protrusion 753 near to the rear end, and an engaging protrusion 754, which is formed on a front side of the annular protrusion 753 for passing into the gaps 732 to engage the seat part 73; each resetting button 75 has two limiting protrusions 755, which face opposite directions, and which have sloping front sides, such that the button 75 will be kept in proper position in the seat 73 with the help of the annular protrusion 753 and the limiting protrusions 755; each button 75 is formed with a rectangular hole 756 on the front end (FIG. 5), and rectangular actuating sticks 76 are respectively passed into the rectangular holes 756 such that the buttons 75 can make the actuating sticks 76 turn together with them, and vice versa; each resetting button 75 has lengthways extending slots 757 such that it can be reduced in circumference when passing into the holes 731 of the seat part 73.

In addition, the actuating sticks 76 are formed with engaging trenches 761, and they are held in the gaps 1415 of the engaging sticks 141 of the buttons 14 at front portions. And, fastening elements 1416 are fitted into the trenches 1414 and 761 of the sticks 141 and 76 to securely join the actuating sticks 76 and the engaging sticks 141 together. Each actuating stick 76 has a gap 762 thereon. And, if the actuating sticks 76 are angular displaced such that the gaps 762 are nearest to the corresponding symbols on the rear cover 64, which are formed with the cavities 643, the corresponding buttons 14 are included in the unlocking combination, and have to be pressed for allowing the lock to be unlocked. Furthermore, the sleeves 67 are securely connected to the indoor member 7 at the rear ends thereof.

Figure 13:
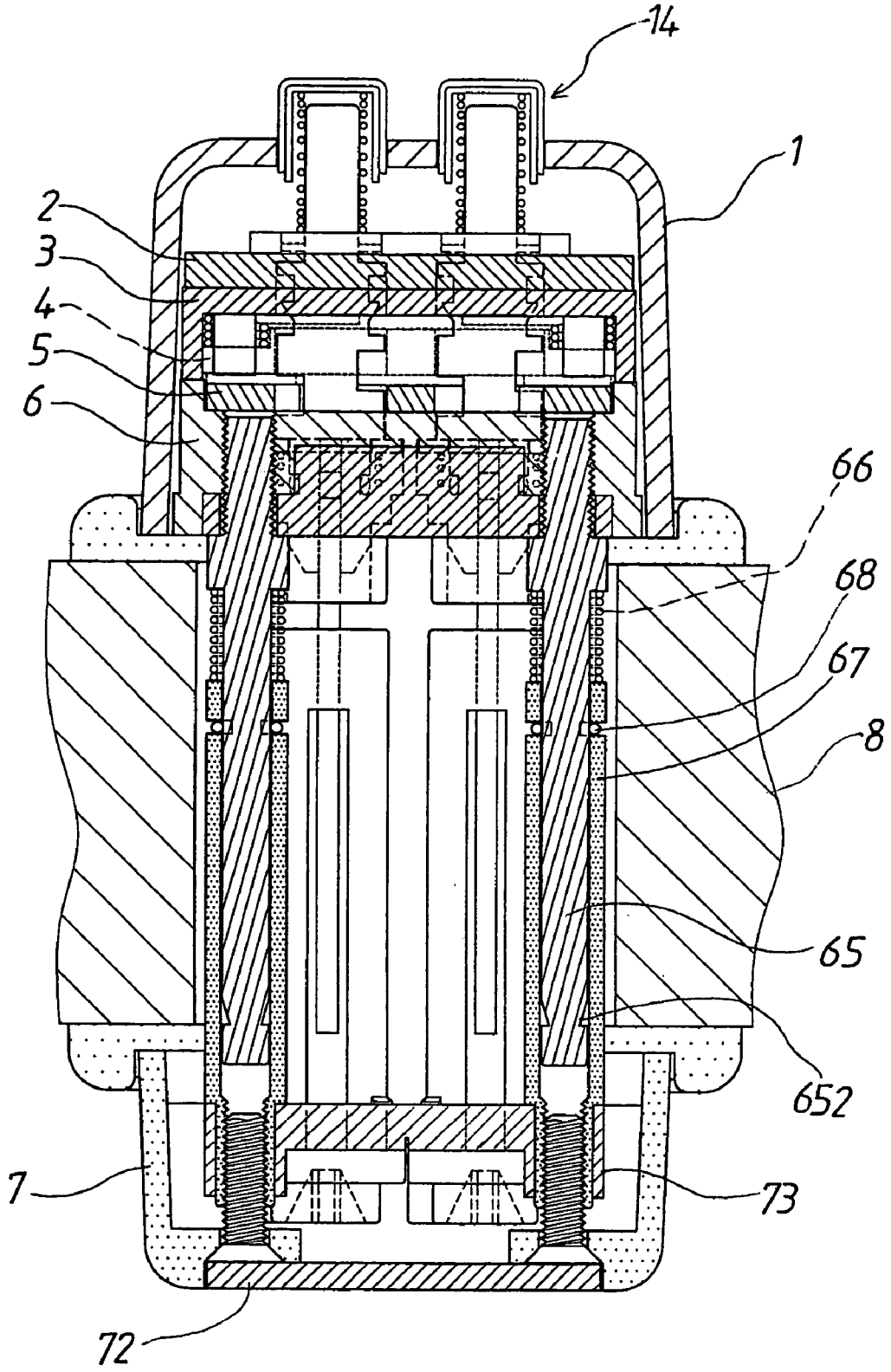
FIG. 13 is a view showing that the present combination lock is adaptable to doors with different thicknesses.
Figure 14:
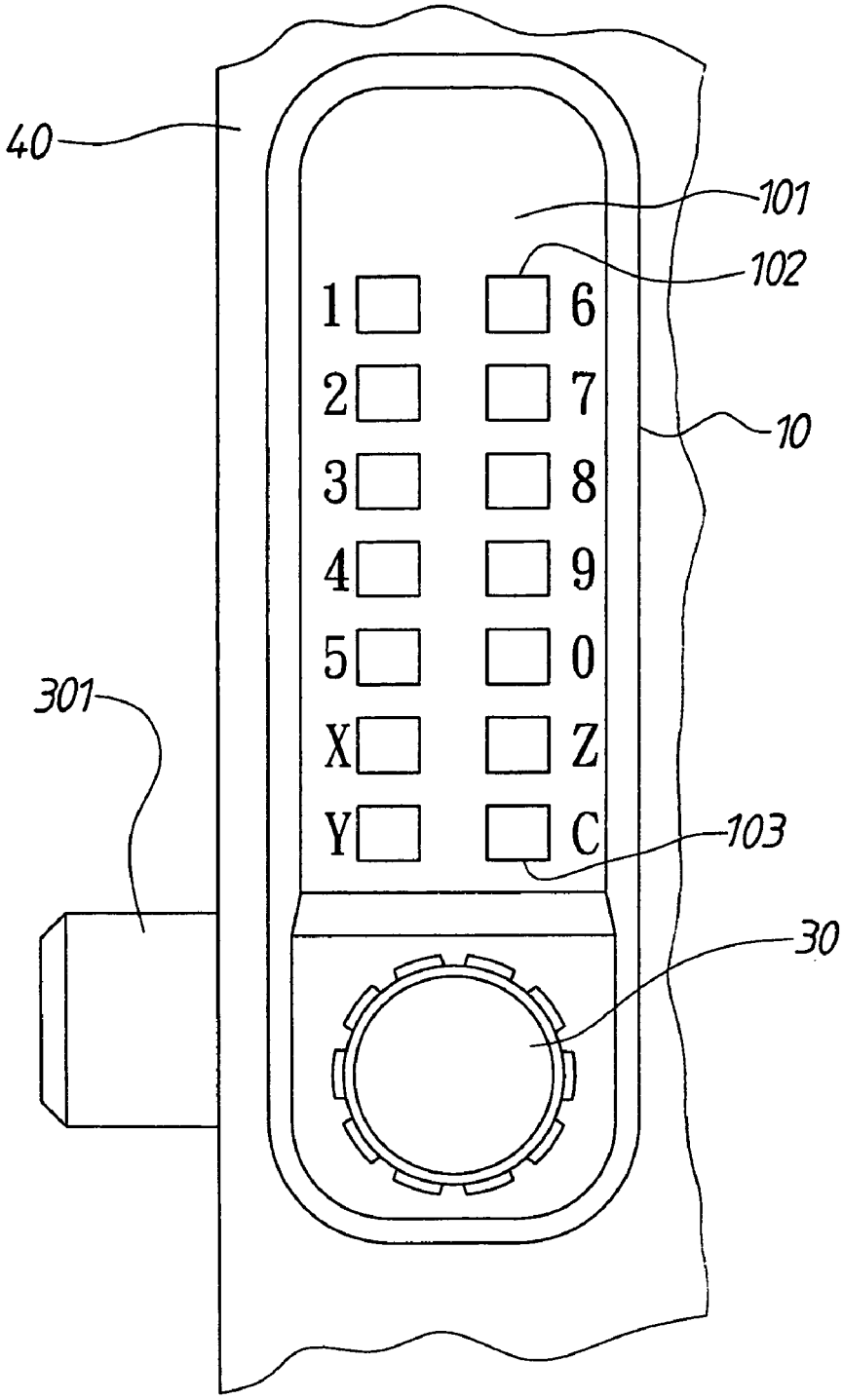
F I G. 14 (PRIOR ART)
FIG. 14 is a front view of the conventional resettable combination lock.
Figure 15:
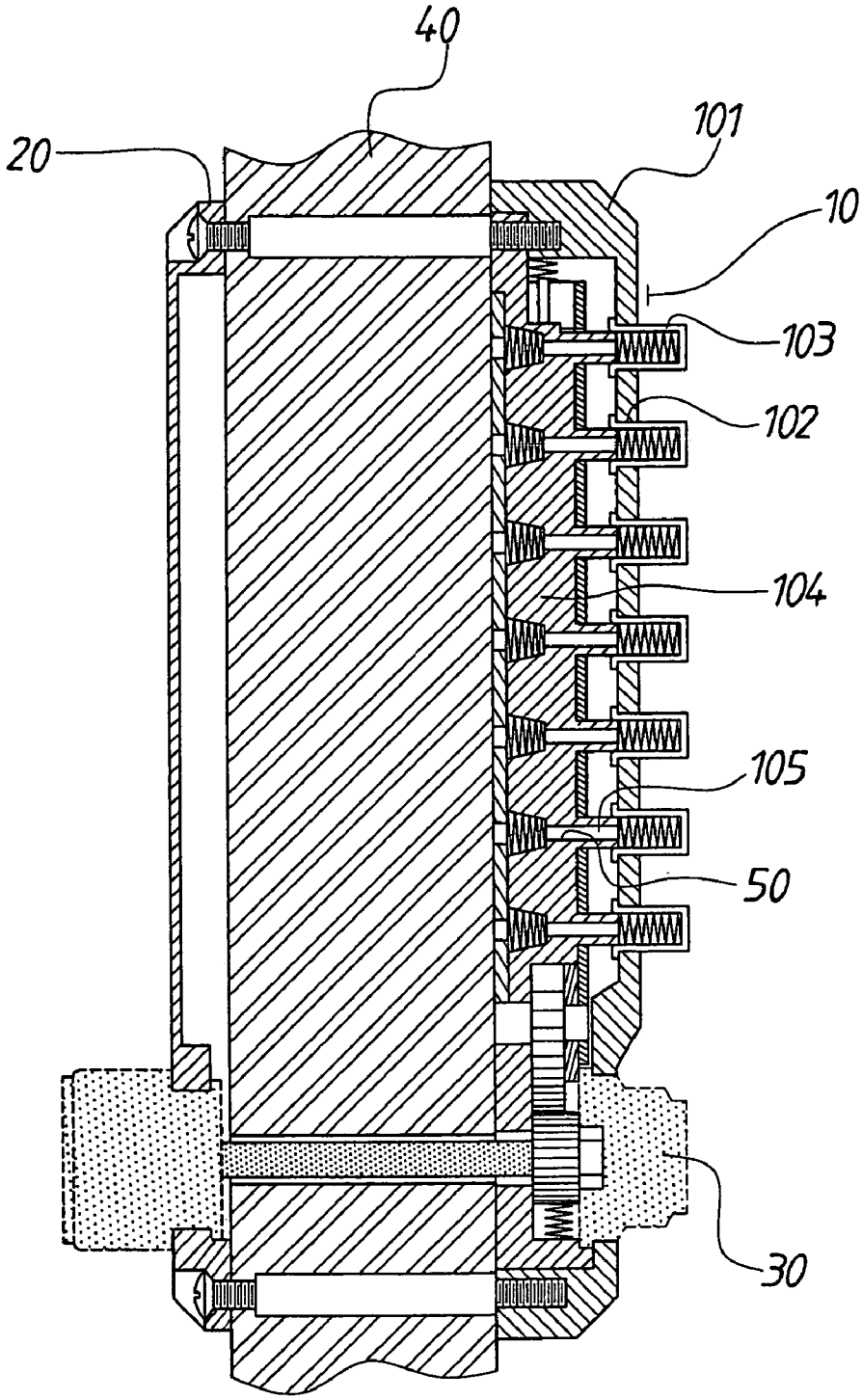
F I G. 15 (PRIOR ART)
FIG. 15 is a sectional view of the conventional combination lock.
Figure 16:
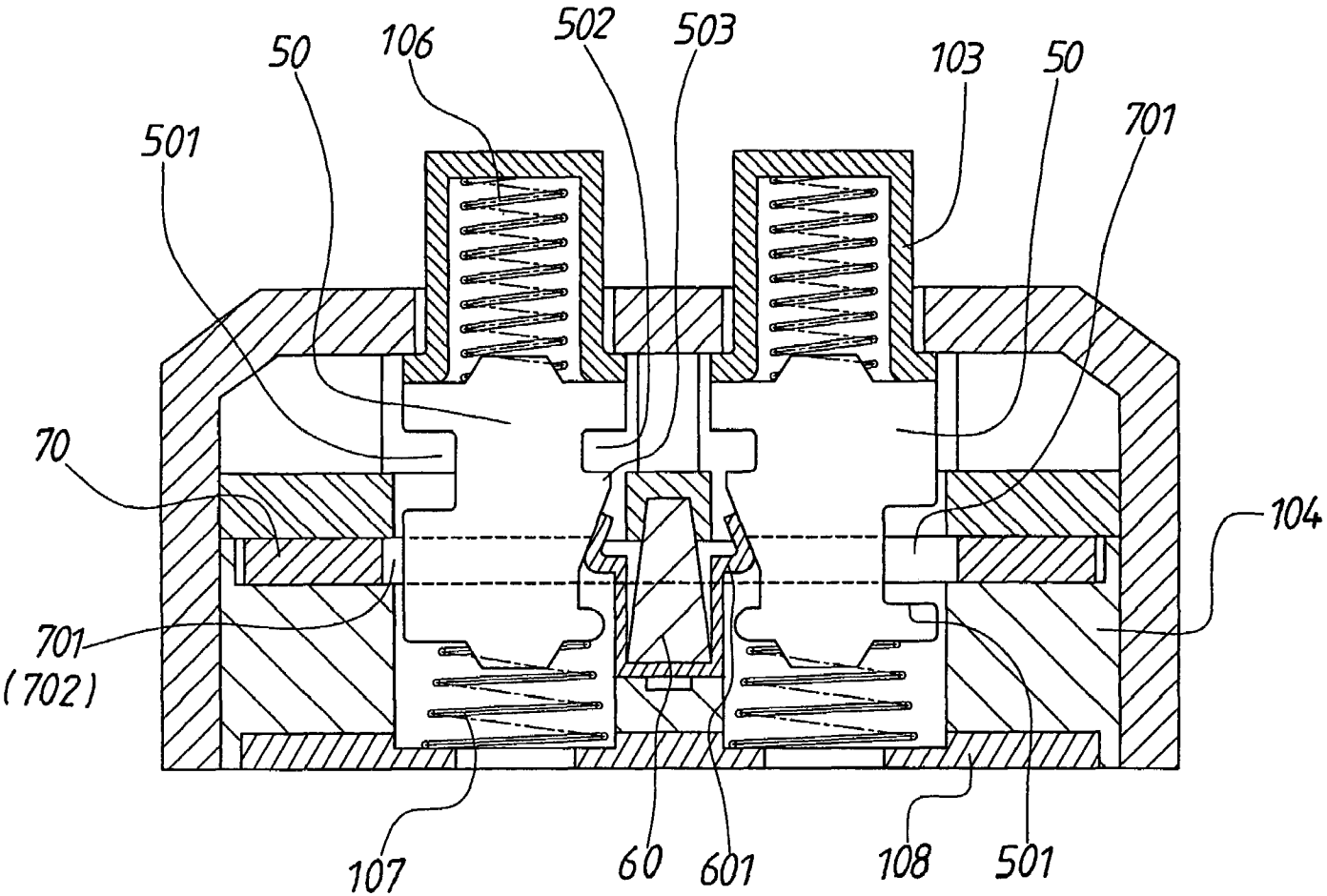
FIG. 16 (PRIOR ART)
FIG. 16 is another sectional view of the conventional lock.
Figure 17:
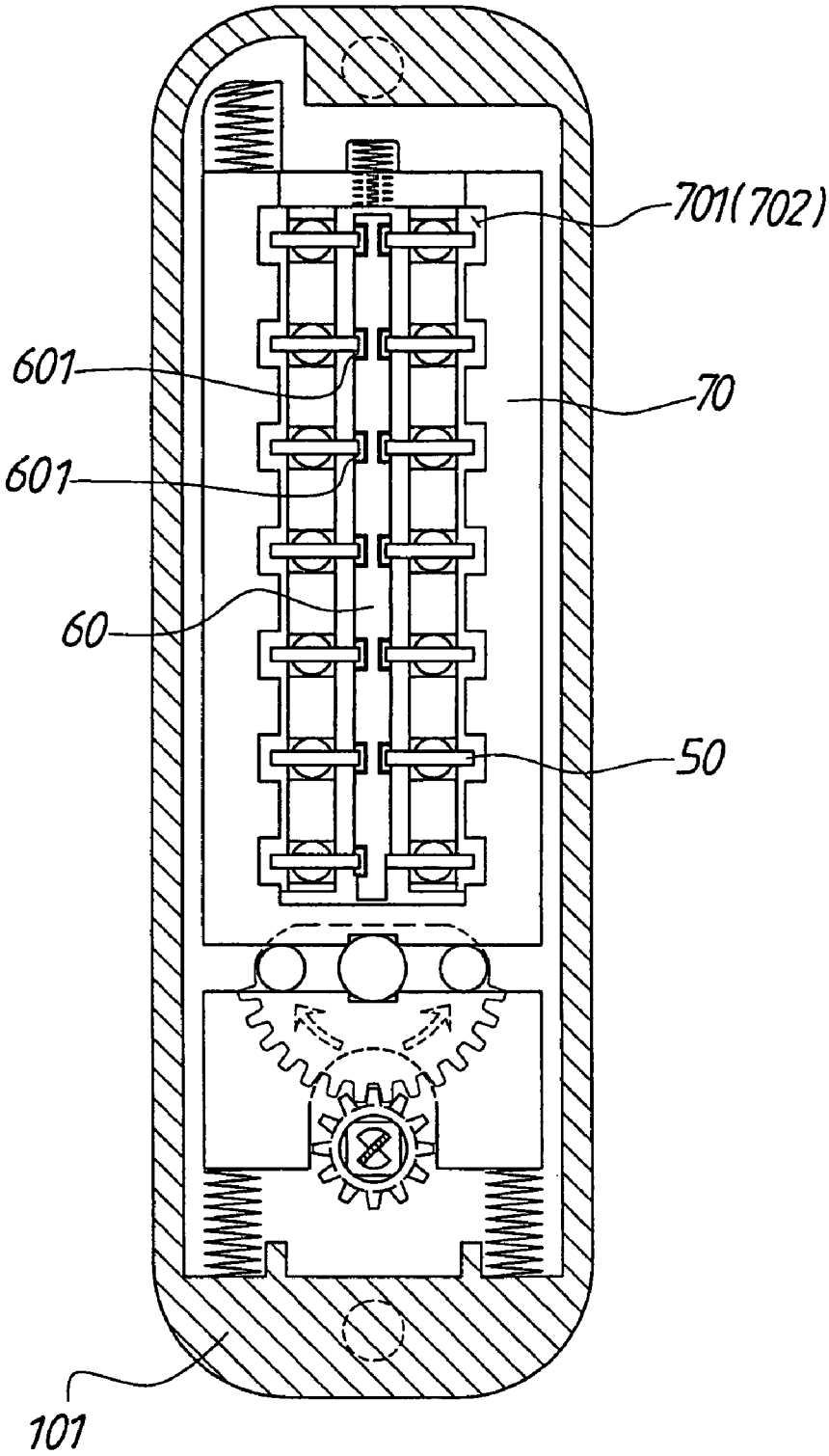
F I G. 17 (PRIOR ART)
FIG. 17 is yet another sectional view of the conventional lock.

Furthermore, because the fixing sticks 65 are securely connected to the rear cover 64 and the rear seat 6, and the sleeves 67 securely connected to the seat part 73 of the indoor member 7, and because the U-shaped clipping elements 68 are fitted in the holes 672 of the sleeves 67 and tightly pressed against the tapering neck portions 652 of the fixing sticks 65, the fixing sticks 65 can be linearly displaced relative to the sleeves 67 as well as the U-shaped clipping elements 68 according to the thickness of a door, on which the present lock is to be secured, thus changing the distance between the outdoor member 1 and the outdoor member 7, as shown in FIG. 13. In other words, thickness of the present lock can be adjusted.

Whether or not a main button 14 is one of the unlocking combination is decided by the direction of the first and the second trenches 1412, 1413 of that button 14; to include certain ones of the buttons 14 in the unlocking combination, the user has to position the certain chosen buttons in such a way that the first trenches 1412 of the engaging sticks 141 face outwards; in other words, the first trenches 1412 and the adjacent long inner edge of the pushing plate 5 face opposite directions. And, the other buttons, which are not included in the combination, have to be positioned so as to face outwards at the second trenches 1413 thereof. The first and the second trenches 1412 and 1413 of the engaging sticks 141 are different distances from the rear ends of the sticks 141, as shown in FIG. 5, and in order to unlock the lock, one has to press those of the buttons 14 that face outwards at the first trenches 1412, and are included in the combination, and he shouldn't press the other buttons, which face outwards at the second trenches 1413 instead, and are not included in the combination; when the buttons included in the combination are in the pressed position, the first trenches 1412 thereof will be exactly faced with the adjacent long inner edge of the pushing plate 5, and the buttons can't stop the pushing plate 5 from moving; if the other buttons are not pressed, which are not included in the combination, the second trenches 1413 thereof will be exactly faced with the adjacent long inner edge of the pushing plate 5, and the buttons can't stop the pushing plate 5 from moving. In other words, the chosen buttons will stop the pushing plate 5 from moving if they are not pressed while the un-chosen buttons will stop the pushing plate 5 from moving if they are in the pressed position.

When the main buttons 14 are pressed, the engaging sticks 141 thereof will engage the torsion springs 37 at the annular protrusions 1417, and detained in the pressed position while the inner and the outer caps 144 and 145 will be biased back to the original position by the springs 143, projecting out form the holes 12 of the housing.

The outdoor member 1 further has a knob 11 thereon, which is connected to a dead bolt as well as the pushing plate 5 such that the knob 11 can be turned to cause linear displacement of the pushing plate 5, providing that the pushing plate 5 is free to move without being stopped by the engaging sticks 141 of the main buttons 14, and such that the dead bolt 301 will be linearly displaced relative to the housing 101 by means of turning the knob 11; the pushing plate 5 will push both the first and the second restoring seat 3 and 4 so as to make the torsion spring 37 disengage the engaging sticks 141 when is linearly displaced by means of turning the knob 11, thus allowing the engaging sticks 141 to be biased back to the original non-pressed position by the springs 62. And, the handle 71 of the indoor member 7 is connected to the dead bolt for retreating the same with.

Figure 11:
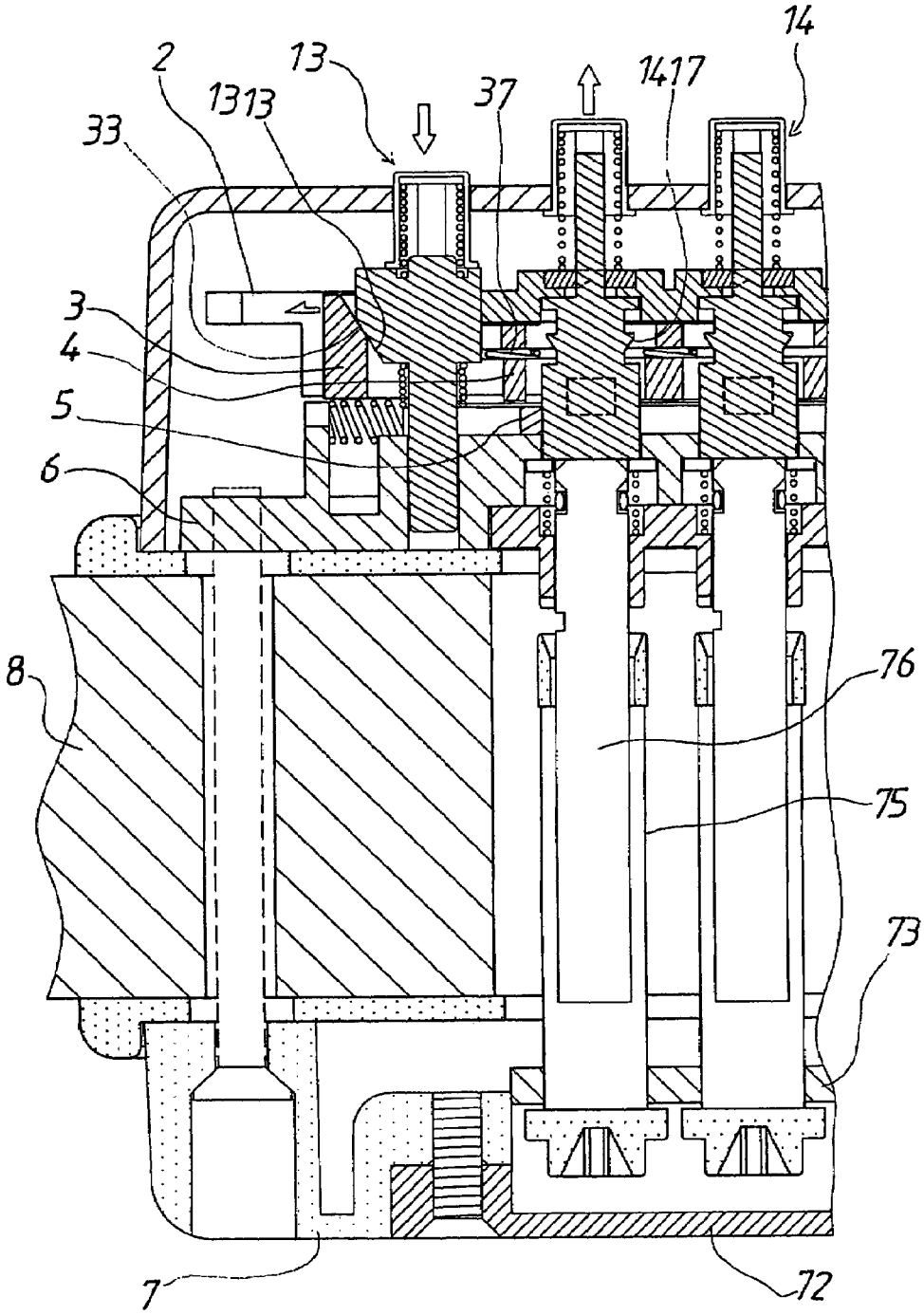
FIG. 11 is a partial sectional view of the present combination lock, with the restoring button being pressed.
Figure 12:
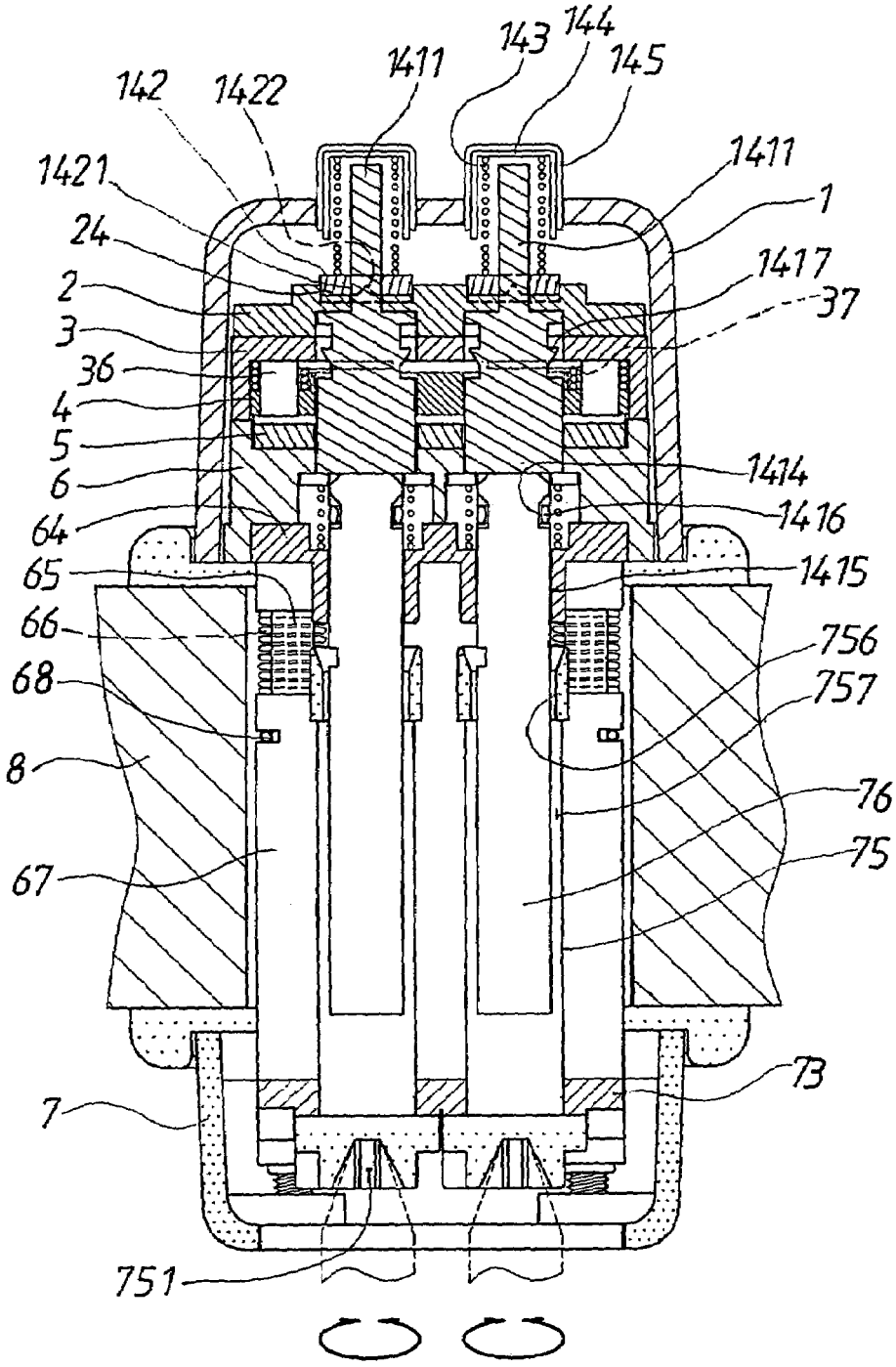
FIG. 12 is a view of the present lock under a resetting action.

The restoring button 13 has to be pressed for restoring the lock to the original condition, in which the buttons 14 are released from the pressed position, if wrong ones of the buttons 14 have been pressed; referring to FIG. 11, when the restoring button 13 is pressed, the rear pushing post 131 thereof will push the first restoring seat 3 with the slope 1313 touching the slope 33 of the first restoring seat 3; thus, the first restoring seat 3 moves towards the springs 35, and causes displacement of the second restoring seat 4 and the torsion springs 37, which are arranged between the first and the second seats 3 and 4, making the torsion springs 37 disengage the engaging sticks 141 of those of the buttons 14 that have been pressed, thus allowing the springs 62 to bias the engaging sticks 141 back to the original non-pressed position. Consequently, one can use the buttons 14 again in order to unlock the lock.

Therefore, the door can't be opened from outside if the lock isn't unlocked with the buttons 141 being pressed exactly according to the combination.

One can reset the present combination lock after the cover 72 of the indoor member 7 is removed for allowing one to use the resetting buttons 75. To reset the lock, a tool is fitted on the engaging cavities 751 of certain chosen ones of the buttons 75, and turned one hundred and eighty degrees so as to cause the same angular displacement to the resetting buttons 75, the actuating sticks 76, the engaging sticks 141 as well as the rings 142 held around the engaging sticks 141; thus, the combination is changed; the recesses 1422 of the rings 142 will separate from the locating protrusions 24 of the fixed seat 2 at the beginning of the rotational movement, and they will fit on the locating protrusions 24 again at the end of the rotational movement. Finally, the cover 72 is secured back on the indoor member 7.

Furthermore, the user can easily find out which buttons 14 of the outdoor member 1 the resetting buttons 75 are respectively associated with the help of the signs 752 thereon, which face the same directions as the corresponding first trenches 1412 of the engaging sticks 141.

From the above description, it can be easily understood that the resettable combination lock of the present invention has advantages as followings:

1. To reset the combination lock, one only has to remove the cover 72 of the indoor member, and turn the rotary resetting buttons 75 by means of a tool therefore the lock is convenient to use.

2. To rest the combination lock, only certain chosen ones of the rotary resetting buttons 75 have to be turned one hundred and eighty degrees such that the trenches 1412 and 1413 change in the orientation relative to the pushing plate 5, and the other ones of the buttons 75 remain unchanged. Therefore, the present lock is much easier to reset than the conventional one whose locking plates have to be removed and relocated, taking a lot of time and labor.

3. The cover 72 is the only part that has to be removed therefore there won't be any risk of the various important inner parts of the lock getting lost in a resetting action.

4. There can't be any damage caused to the various important inner parts of the lock in a resetting action because the rotary resetting buttons will be merely turned. And, one can reset the lock easily and with single hand.

5. All of the engaging sticks 141 of the buttons 14 have the same shape therefore the manufacturing and management of the engaging sticks 141 will be easier than that of the two different types of locking plates of the conventional lock.

6. The present lock is adaptable to doors of various thickness because of the combinations of fixing sticks 65, springs 66, and sleeves 67, which are connected to both the seat 73 and the rear cover 64 at two ends, and which together allow the distance between the indoor member 7 and the outdoor member 1 to be adjusted.

What is claimed is:

1. A resettable combination lock, comprising (a) an outdoor member secured on a front side of a door, the outdoor member including:

(1) a housing having a knob thereon;

(2) a plurality of spaced main buttons passed through a front portion of the housing; each main button including an engaging stick, and a ring formed with recesses on a rear side thereof; the rings being positioned around respective ones of the rings such that the sticks can cause rotational movement of the rings together with them; each engaging stick having a middle portion formed with both first and second trenches, which face opposite directions, and which are different distances from a rear end of the engaging stick; each engaging stick having an annular protrusion in front of the first and the second trenches thereof;

(3) a restoring button passed through the front portion of the housing, used for restoring the lock to an original condition, in which all of the main buttons are away from depressed position and project out from the front side of the housing; the restoring button being formed with a slope on a rearwards portion thereof;

(4) a fixed seat positioned next to a rear side of the front portion of the housing; the fixed seat having a plurality of holes, through which the main buttons are respectively passed; the fixed seat having locating protrusions next to edges of the holes thereof on a front side for fitting the recesses of the rings respectively;

(5) a first restoring seat positioned next to a rear side of the fixed seat in the housing; the first restoring seat having a first hole on a first end, through which the restoring button is passed; the first restoring seat having a plurality of second holes, through which the engaging sticks of the main buttons are respectively passed; the first restoring seat having a sloping portion facing and near to the slope of the restoring button; the first restoring seat being equipped with plural springs at the first end thereof; the first restoring seat having a plurality of second locating posts next to the second holes on a rear side; torsion springs being fitted onto respective ones of the second posts and pressed against lateral wall portions of the first seat and corresponding engaging sticks of the main buttons at two ends thereof;

(7) a second restoring seat positioned next to the first restoring seat in the housing; the second restoring seat having a plurality of holes, through which the engaging sticks of the main buttons are passed; the first and the second restoring seats being connected such that they are co-movable together with each other;

(8) a pushing plate positioned next to the second restoring seat in the housing; the pushing plate having two slots lengthwise extending along it, through which the engaging sticks of the main buttons are passed; edges of the slots being formed with spaced apart concavities and straight portions between adjacent ones of the concavities; the pushing plate being biased away from a first end by means of springs connected to the first end thereof; the concavities of the pushing plate being going to face corresponding ones of the engaging sticks of the main buttons when the springs thereon are free to stretch without compressing force exerted thereon; the pushing plate having a pushing protrusion, which is pressed against the first and the second restoring seats; the knob of the outdoor member being connected to a dead bolt as well as the pushing plate such that the knob can be turned to cause linear displacement of the pushing plate, providing that the pushing plate is free to move without being stopped by the engaging sticks of the main buttons, and such that the dead bolt will be linearly displaced relative to the housing when the knob turns;

(9) a rear seat disposed next to the pushing plate; the rear seat having two rows of spaced holes, each of which rows face a respective slot of the pushing plate; springs being respectively held in the holes of the rear seat, and pressed against the engaging sticks of the main buttons for biasing the sticks forwards; and (b) an indoor member secured on a rear side of the door; the indoor member having a handle thereon; the indoor member including a plurality of actuating sticks for resetting the lock; the actuating sticks being respectively securely connected to the engaging sticks of the main buttons for causing angular displacement of the engaging sticks;

the pushing plate being going to be stopped from moving by those of the main buttons whose first trenches face outwards when the buttons are in non-pressed position, which first trenches won't be exactly faced with the edges of the slots of the pushing plate unless the buttons are pressed; the pushing plate being not going to be stopped by those of the main buttons whose second trenches face outwards when the buttons are in non-pressed position, which second trenches will be exactly faced with the edges of the slots of the pushing plate until the buttons are pressed;

whereby the lock will be unlocked, and the pushing plate movable as soon as the main buttons are pressed exactly according to an unlocking combination; and whereby the lock can be reset in combination by means of turning the actuating sticks one hundred and eighty degrees such that the first and the second trenches of the engaging sticks of the main buttons change in directions.

2. The resettable combination lock as claimed in claim 1, wherein:

a plurality of telescopic connecting elements are connected to both a cover part of the rear seat and a seat part of the indoor member; each of the telescopic connecting elements including a front fixing stick, a spring, and a rear sleeve; the fixing sticks being screwed through the cover part and the rear seat at front ends; the sleeves being securely connected to the seat part of the indoor member; each fixing stick having a tapering neck portion passed into a corresponding sleeve; the springs being connected to the sleeves and the fixing sticks in such as way as to bias the fixing sticks forwards and away from rear ends of the sleeves; each sleeve having two opposing holes communicating with a central room thereof; U-shaped clipping elements being fitted in the opposing holes of the sleeves and tightly pressed against the tapering neck portions of the fixing sticks for preventing the fixing sticks from separating from the sleeves, such that distance between the indoor and the outdoor member is changeable with the telescopic elements being changed in length, thus suiting doors of various thicknesses; and a plurality of rotary resetting buttons are passed through the seat part for causing angular displacement of the main buttons with; the actuating sticks being connected to respective ones of the resetting buttons in such a way that they are linearly displaceable relative to the resetting buttons, and that they will turn together with the resetting buttons.

3. The resettable combination lock as claimed in claim 1, wherein the restoring button includes a rear pushing post, a front spring, and an outer cap; the rear pushing post having a rear post portion passed through the fixed seat; the rear pushing post having a block portion at a front end; the block having a recess at a front end, on which the front spring is located at a rear end; the outer cap being positioned over a front end of the spring and projecting out from the front portion of the housing.

4. The resettable combination lock as claimed in claim 3, wherein an inner cap is held between the front end of the spring and the outer cap of the restoring button.

5. The resettable combination lock as claimed in claim 1, wherein each of the engaging sticks of the main buttons has a front post portion, and a spring positioned around the front post portion thereof, and each main button has an outer cap, which is positioned over a front end of a corresponding spring.

6. The resettable combination lock as claimed in claim 5, wherein each of the main buttons has an inner cap held between the front end of the spring and the outer cap thereof.

7. The resettable combination lock as claimed in claim 1, wherein the first restoring seat is formed with a plurality of locating posts at the first end thereof, and the springs are respectively positioned around and located by the locating posts.

8. The resettable combination lock as claimed in claim 1, wherein the second restoring seat has a plurality of second holes on a front side, and the second locating posts of the first restoring seat are fitted in the second holes of the second seat such that the first and the second seats are co-movable together with each other.

9. The resettable combination lock as claimed in claim 1, wherein the pushing plate is formed with a plurality of locating posts at the first end thereof, and the springs are respectively fitted onto and located by the locating posts.

10. The resettable combination lock as claimed in claim 1, wherein each engaging stick has an annular trench around a rear portion thereof, and a gap extending along a rear portion while each of the actuating sticks is formed with engaging trenches on a front portion; the actuating sticks being respectively passed into the gaps of the rear portions of the engaging sticks at front ends; the actuating sticks being held in the gaps of the rear portions of the engaging sticks of the main buttons; fastening elements being fitted into the trenches of the engaging sticks and the actuating sticks.

11. The resettable combination lock as claimed in claim 2, wherein the seat part of the indoor member has two rows of spaced holes thereon, and the rotary resetting buttons are respectively passed through the holes of the seat part.

12. The resettable combination lock as claimed in claim 11, wherein each of the resetting buttons has a plurality of slots lengthways extending along it such that it can be reduced in circumference when passing into the seat part.

13. The resettable combination lock as claimed in claim 11, wherein each rotary resetting button has an annular protrusion near to a rear end, and a plurality of limiting protrusions in front of the annular protrusion, all of which protrusions are formed so as to help the resetting button kept in position in the seat part of the indoor member; each of the limiting protrusions having a sloping front side.

14. The resettable combination lock as claimed in claim 11, wherein a rear side of the cover of the rear seat has symbols thereon, which consist of cavities, and which are next to the edges of the spaced holes of the cover of the rear seat, and each of the actuating sticks is formed with a gap; when the actuating sticks are turned to such a position that the gaps thereof are nearest to corresponding symbols of the cover of the rear seat, corresponding main buttons connected therewith will have to be pressed in order to unlock the lock.

15. The resettable combination lock as claimed in claim 2, wherein the rotary resetting buttons have recesses on rear ends thereof for allowing a tool to be fitted on.

16. The resettable combination lock as claimed in claim 2, wherein each rotary resetting button has a sign facing in the rearward direction, which is used for helping a person to find out which one of the main buttons the resetting button is associated with.

* * * * *